United States Patent [19]

Richert

[11] Patent Number: 4,457,534

[45] Date of Patent: Jul. 3, 1984

[54] HEELHOLDER FOR SAFETY SKI BINDING

[75] Inventor: Manfred Richert, Farchant, Fed. Rep. of Germany

[73] Assignee: Marker-Patentverwertungsgesellschaft mbH., Baar, Switzerland

[21] Appl. No.: 299,220

[22] Filed: Sep. 3, 1981

[30] Foreign Application Priority Data

Sep. 5, 1980 [DE] Fed. Rep. of Germany ..... 3033568

[51] Int. Cl.[3] ..... A63G 9/08

[52] U.S. Cl. ..... 280/631

[58] Field of Search ..... 280/628, 631, 632, 633, 280/634

[56] References Cited

U.S. PATENT DOCUMENTS

| | | | |
|---|---|---|---|
| 3,606,369 | 9/1971 | Batal | 280/634 |
| 3,909,023 | 9/1975 | Zoor | 280/631 |
| 4,103,930 | 8/1978 | Valoh | 280/631 |
| 4,214,773 | 7/1980 | Wittman | 280/631 |

FOREIGN PATENT DOCUMENTS

| | | | |
|---|---|---|---|
| 296839 | 2/1972 | Austria . | |
| 2340420 | 2/1975 | Fed. Rep. of Germany . | |
| 2432646 | 1/1976 | Fed. Rep. of Germany | 280/631 |
| 2450163 | 5/1976 | Fed. Rep. of Germany | 280/631 |

*Primary Examiner*—Joseph F. Peters, Jr.
*Assistant Examiner*—Timothy Roesch
*Attorney, Agent, or Firm*—D. Peter Hochberg

[57] ABSTRACT

A heel holder of a ski binding for assuming an open position from a closed position when a ski boot is released from a toe holder of the binding, the heelholder including a baseplate, a housing mounted on the baseplate, a soleholder pivotally mounted on the housing for rotation between open and closed positions, a retaining member mounted on the soleholder for releasably retaining the soleholder in the closed position, a locking member for releasably restraining the retaining member to lock the soleholder in the closed position, a blocking member for blocking the retaining member from movement from its restrained position and a release member for moving the blocking member to free the retaining member when a ski boot is released from the toe holder to enable the opening of the soleholder.

4 Claims, 3 Drawing Figures

HEELHOLDER FOR SAFETY SKI BINDING

This invention relates to a heelholder for a safety ski binding, which heelholder comprises a baseplate adapted to be secured to the top of the ski, a housing mounted on said baseplate, a soleholder that is pivoted to said housing on a horizontal transverse axis and biased to an opening spring and carries a closing pedal, a locking lever, which is pivoted to said housing on an axis that is parallel to said transverse axis, a restraining spring biasing said locking lever, which when the heelholder is in operative position (when the skiing boot has been inserted) interengages with a part carried by the soleholder and optionally a handle for arbitrarily opening the heelholder.

Various embodiments of such heelholders are known. All of them have the disadvantage that when the skiing boot is released by the toe iron the soleholder will not automatically move to its open position. As a result, after a release caused by a twisting fall, which occurs much more frequently than a release after a frontal fall, the heelholder must be moved to its open position by a separate manipulation before the boot can be re-inserted into the binding.

From a paper state of the art (German Early Disclosure No. 25 35 579) it is known to provide a heelholder which is free from the above-mentioned disadvantage and opens automatically whenever the skiing boot has been released by the safety binding. But the design proposed to that end is so poor that that heelholder has not been accepted in practice.

In that design the housing is provided with a separate member for retaining the soleholder and said retaining member is also pivoted on a transverse horizontal axis. The locking lever serves also as a handle for arbitrarily opening the heelholder. Constant release values cannot be obtained with such bindings owing to the strong influences which are due to friction. Besides, it is not possible to close the binding when there is snow under the sole.

It is an object of the present invention so to improve designs which have proved well in practice that the soleholder will automatically move to its open position when the skiing boot is released by the safety ski binding .

In a heelholder of the kind described first hereinbefore, this object is accomplished in accordance with the invention in that said part which is carried by the soleholder and interengageable with the locking lever is movable relative to the soleholder and is blocked in operative position by blocking means, and that a release member is provided, which is biased by the restaining spring and adapted to cooperate with the blocking means.

Further features of the heelholder according to the invention will become apparent as the description proceeds.

Figure 1:
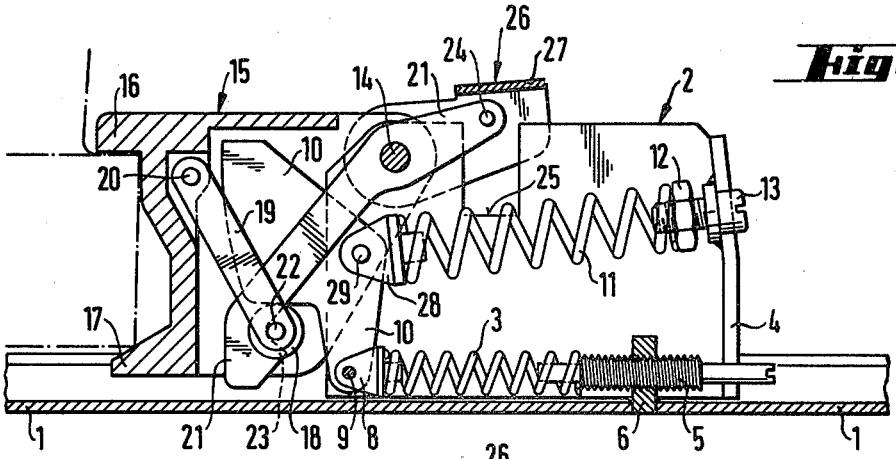
Figure 2:
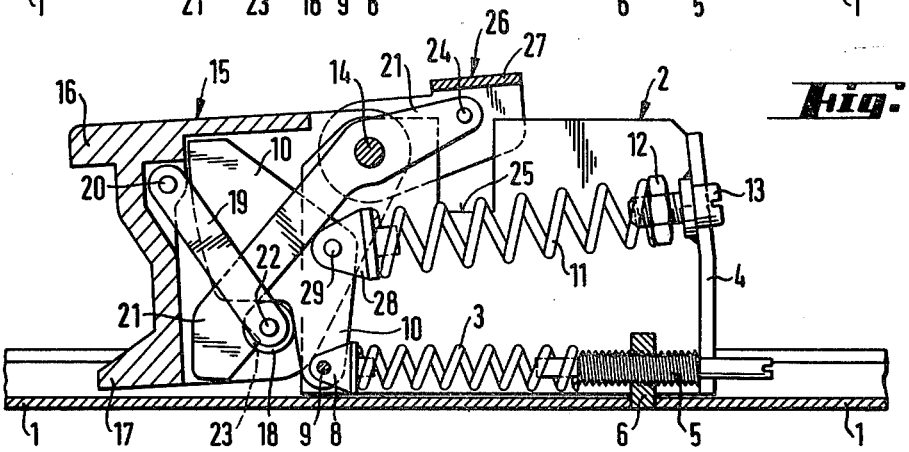
Figure 3:
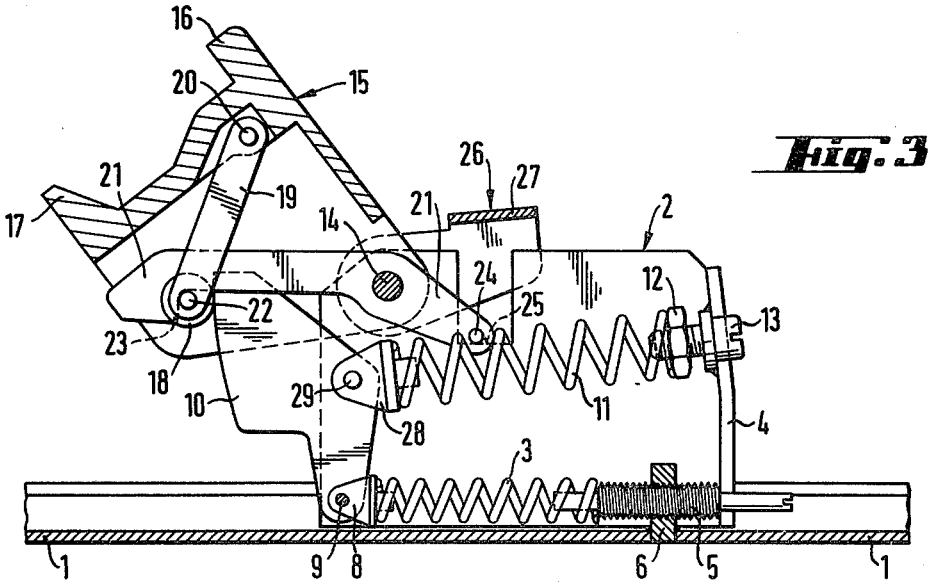

An embodiment of the invention will now be described by way of example with reference to the accompanying drawing, in which FIG. 1 is a central longitudinal sectional view showing the heelholder in operative position, when the skiing boot has been inserted;

FIG. 2 is a view that is similar to FIG. 1 but shows the heelholder as it is automatically opened in response to a release of the skiing boot by the toe iron, which is not shown; and FIG. 3 shows the heelholder of FIGS. 1 and 2 in an open position.

The heelholder shown on the drawing comprises a baseplate 1, which is adapted to be secured in conventional manner to the top of a ski, not shown. A slide 2 which is similar to a housing is mounted on the baseplate and is slidable in the longitudinal direction. The slide is biased by a contact pressure spring 3, which when the heelholder is in its open position, shown in FIG. 3, holds the slide in its forward end position. That end position is defined by the engagement of the rear end wall 4 of the slide with a collar of an adjusting screw 5. The adjusting screw has screw threads in threaded engagement with a tapped hole of a retaining member 6, which is secured to the baseplate 1.

The contact pressure spring acts through the intermediary of a pressure-applying member 8 on a crosspin 9, which is held in the side walls of the slide 2. A locking lever 10 is mounted on said crosspin and is biased by a restraining spring 11, which bears on the rear end wall 4 of the slide 2 through the intermediary of a nut 12 and an adjusting screw 13.

A pivot pin 14 which is parallel to the crosspin 9 is secured in the side walls of the slide 2. A soleholder generally designated 15 is mounted on the pivot pin 14 and is biased by an opening spring, which is conventional and for this reason is not shown. When no skiing boot has been inserted into the binding, the opening spring holds the soleholder in the open position shown in FIG. 3. The soleholder 15 comprises a holding-down member 16 and a pedal spur 17.

In accordance with the invention that part which is carried by the soleholder and interengageable with the locking lever is movable relative to the soleholder and in its operative position is locked by blocking means. In the present case the locking lever 10 cooperates with a retaining means in the form of a detent roller 18 and a lever 19 on which it is mounted. The latter is pivoted to the soleholder 15 on a horizontal crosspin 20. A blocking lever 21 is mounted on the pivot pin 14 and serves to block the lever 19 when the heelholder is in operative position, shown in FIG. 1, and in its open position, shown in FIG. 3. The blocking lever has a nose 23, which normally interengages with the axle 22 of the detent roller 18 so that the latter is normally blocked against movement relative to the soleholder 15. Beyond the pivot pin 14, the blocking lever has an actuating arm, which at its free end carries a stop 24, which limits the pivotal movement of the blocking lever in the clockwise sense when viewed as in the drawing. To that end, the stop 24 engages a counterstop 25 formed by a portion of the side wall of the slide 2. An opening lever 26 is mounted on the pivot pin 14 and has a cross-member 27, which extends over the actuating arm of the blocking lever 21. The above-mentioned opening spring, not shown, which is associated with the soleholder 15, biases the opening lever so that it normally assumes the position shown on the drawing. In that position the opening lever does not act on the blocking lever 21.

The heelholder operates as follows:

The skiing boot is stepped into the binding in the known manner so that the heelholder moves from the position of FIG. 3 to the position of FIG. 1. A comparison of the two Figures shows that in one position the slide 2 has been displaced to the right in the drawing against the force of the contact pressure spring 3 and that in the other position the locking lever 10 engages the detent roller 18 from behind.

If the holding-down member 16 of the soleholder 15 is subjected to an upwardly directed force which exceeds the opposing force of the restraining spring 11, the locking lever 10 will be turned back in the conventional manner so that a safety release is effected by the heelholder, which then assumes the position shown in FIG. 3.

The heelholder can be opened arbitrarily in that the opening lever 26 is depressed so that a pivotal movement is imparted to the blocking lever and the nose 23 then releases the axle 22 of the detent roller. Under the biasing force exerted by the restraining spring 11, the locking lever 10 can perform a small additional pivotal movement until it engages a stop, not shown. As a result of that pivotal movement the axle 22 of the detent roller 18 turns around the nose and under the influence of the opening spring, not shown, is entrained by the soleholder 15 to move around the locking lever 10 until the soleholder has assumed the position shown in FIG. 3. Before that position has been reached, the stop 24 of the blocking lever 21 has engaged the counterstop 25 so that the blocking lever is in its end position and the axle 22 snaps in automatically behind the nose 23 during the final part of the movement of the soleholder. When it is desired to open the heelholder it will obviously be necessary to relieve the pedal spur 17 of the soleholder 15 from the skier's weight.

When the skiing boot is released by the toe iron, not shown, the restraining spring 11 will first force the soleholder 15 down to the position shown in FIG. 2. Before the illustrated position has been reached, a release member has engaged the blocking lever 21 and has turned the same relative to the axle 22 to the release position which is illustrated. In the embodiment shown the release member is constituted by a pressure-applying member or release lever 28, which is pivoted to the locking lever 10 by a pin 29 and transmits the force of the releasing spring 11 to the locking lever 10. The opening operation is then continued as during the arbitrary opening. The locking lever 10 first continues its pivotal movement until its above-mentioned stop engages the counterstop. Then the axle 22 has moved around the nose 23 and the opening is completed under the influence of the opening spring acting on the soleholder 15. The position shown in FIG. 3 is finally reached.

As the heelholders shown and described have a handle for arbitrarily opening them, they can be combined with conventional toe irons in a safety ski binding. Besides, the heelholders according to the invention can be used to advantage with toe irons which can be opened arbitrarily but return to their initial position when the skiing boot has been released. In that case the safety ski binding provided with the heelholder according to the invention is always ready to receive the skiing boot. It will be understood that the handle for arbitrarily opening the heelholder is not required in such a combined binding.

What is claimed is:

1. A heelholder for a safety ski binding, said heelholder comprising:

a baseplate mountable on a ski;

a housing mounted on said baseplate;

a soleholder pivotally mounted on said housing for rotation between closed and open positions, said soleholder being releasably engageable with the sole of a ski boot to secure the boot to the ski;

retaining means movably mounted on said soleholder for releasably retaining said soleholder in the closed position;

locking means movably mounted on said housing for releasably restraining said retaining means to lock said soleholder in the closed position when a ski boot is in said soleholder;

blocking means mounted on said housing and being movable between a blocking position for releasably blocking said retaining means in a position to be restrained by said locking means, and a releasing position for enabling movement of said retaining means out of the restraint of said locking means;

release means mounted on said locking means for moving said blocking means from said blocking position to said releasing position to release said retaining means in response to removal of a ski boot from the soleholder without the application of a releasing force by the ski boot to the soleholder;

and biasing means for urging said release means to move said blocking means towards said releasing position in response to removal of a ski boot from the soleholder without the application of a releasing force by the ski boot to the soleholder, and for moving said locking means to release said retaining means, said retaining means moving out of the restraint of said locking means in response to the movement of said blocking means to said releasing position and to the foregoing movement of said locking means, to release said soleholder after said release means moves said blocking means.

2. The invention according to claim 1 wherein said retaining means comprises a lever pivotally mounted on said soleholder, and a roller engageable by said locking means and said blocking means.

3. The invention according to claim 1 wherein said locking means comprises a locking lever pivotally mounted on said housing, said release means comprises a release lever pivotally mounted on said locking lever, and said biasing means comprises a spring connected at one end to said housing and at another end to said release lever.

4. The invention according to claim 3 wherein said blocking means comprises a blocking lever pivotally mounted on said housing, said blocking lever being movable by said release lever under the influence of said spring to release said retaining means.

* * * * *